US009711250B2

(12) United States Patent
Cabauy

(10) Patent No.: US 9,711,250 B2
(45) Date of Patent: Jul. 18, 2017

(54) TRITIUM DIRECT CONVERSION SEMICONDUCTOR DEVICE HAVING INCREASED ACTIVE AREA

(71) Applicant: Peter Cabauy, Miami, FL (US)

(72) Inventor: Peter Cabauy, Miami, FL (US)

(73) Assignee: City Labs, Inc., Homestead, FL (US)

( * ) Notice: Subject to any disclaimer, the term of this patent is extended or adjusted under 35 U.S.C. 154(b) by 397 days.

(21) Appl. No.: 14/313,953

(22) Filed: Jun. 24, 2014

(65) Prior Publication Data

US 2015/0001988 A1 Jan. 1, 2015

Related U.S. Application Data

(60) Provisional application No. 61/838,692, filed on Jun. 24, 2013.

(51) Int. Cl.
*G21H 1/00* (2006.01)
*G21H 1/06* (2006.01)

(52) U.S. Cl.
CPC ..... *G21H 1/06* (2013.01)

(58) Field of Classification Search
CPC ..... G21H 1/06
USPC ..... 310/301, 302, 303, 304, 305; 438/56
See application file for complete search history.

(56) References Cited

U.S. PATENT DOCUMENTS

| | | | | |
|---|---|---|---|---|
| 7,663,288 | B2 | 2/2010 | Chandrashekhar | |
| 7,939,986 | B2 | 5/2011 | Chandrashekhar et al. | |
| 8,487,507 | B1 * | 7/2013 | Cabauy | G21H 1/06 310/301 |
| 2007/0080605 | A1 | 4/2007 | Chandrashekhar | |
| 2011/0079791 | A1 | 4/2011 | Chandrashekhar | |

* cited by examiner

*Primary Examiner* — Hanh Nguyen
(74) *Attorney, Agent, or Firm* — Beusse, Wolter, Sanks & Maire, PLLC; John L. DeAngelis

(57) ABSTRACT

A betavoltaic power source. The betavoltaic power source comprises a source of beta particles, a substrate with shaped features defined therein and a InGaP betavoltaic junction disposed between the source of beta particles and the substrate, and also having shaped features therein responsive to the shaped features in the substrate, the InGaP betavoltaic junction device for collecting the beta particles and for generating electron hole pairs responsive thereto.

8 Claims, 6 Drawing Sheets

TRITIUM DIRECT CONVERSION SEMICONDUCTOR DEVICE HAVING INCREASED ACTIVE AREA

CROSS REFERENCE TO RELATED APPLICATIONS

The present invention claims priority under 35 U.S.C. 119(e) to the provisional patent application filed on Jun. 24, 2013 and assigned application No. 61/838,692. This provisional patent application is incorporated in its entirety herein.

FIELD OF THE INVENTION

The present invention applies to betavoltaic batteries having increased active area (e.g., surface area) to increase device efficiency by absorbing more beta particles.

BACKGROUND OF THE INVENTION

The direct conversion of radioisotope beta (electron) emissions into usable electrical power via beta emissions directly impinging on a semiconductor junction device was first proposed in the 1950's. Incident beta particles absorbed in a semiconductor create electron-hole-pairs (EHPs) which are accelerated by the built-in field to device terminals, and result in a current supplied to a load resistor. These devices are known as Direct Conversion Semiconductor Devices, Beta Cells, Betavoltaic Devices, Betavoltaic Batteries, Isotope Batteries etc. These direct conversion devices promise to deliver consistent long-term battery power for years and even decades. For this reason, many attempts have been made to commercialize such a device. However, in the hopes of achieving reasonable power levels, the radioisotope of choice often emitted unsafe amounts of high energy radiation that would either quickly degrade semiconductor device properties within the betavoltaic battery or the surrounding electronic devices powered by the battery. The radiated energy may also be harmful to operators in the vicinity of the battery.

As a result of these disadvantages and in an effort to gain approval from nuclear regulatory agencies for these types of batteries, the choice for radioisotopes has been limited to low-energy beta (electron) emitting radioisotopes, such as nickel-63, promethium-147 or tritium. Due to the fact that promethium-147 is regulated more stringently, requires considerable shielding, and nickel-63 has a relatively low beta flux, tritium has emerged as a leading candidate for such a battery device.

Tritium betavoltaic batteries, sometimes referred to as tritium betavoltaic devices or tritium direct conversion devices, have been promoted during the last thirty years. Tritium is a relatively benign radioisotope with low beta energy emission that can easily be shielded with as little as a thin sheet of paper. Tritium has a long track record in commercial use in illumination devices such as EXIT signs in commercial aircraft, stores, school buildings and theatres. It is also widely used in gun sights and watch dials, making it an ideal power source for the direct conversion devices. Given the low power and relatively large size of a typical tritium betavoltaic cell, it has been difficult to produce a device with meaningful power that is both cost-effective and space-efficient.

Several attempts have been made to produce useful current from a tritium betavoltaic battery. For example, polycrystalline or amorphous semiconductor devices have been considered for tritium betavoltaic batteries based on the assumption that such devices would allow batteries to be fabricated at a reduced cost. It is assumed that these devices could be manufactured in a thin-film like fashion and that tritium could be embedded within the polycrystalline or amorphous devices. However, this approach is extremely inefficient (much less than 1%) with respect to the beta energy emissions entering the semiconductor. The main reason for this low semiconductor conversion efficiency is the high dark current or leakage current of the semiconductor that acts as a negative current. This high dark current competes with the betavoltaic current produced by collection of EHPs created via the tritium beta particles impinging on the semiconductor. In short, the polycrystalline and amorphous semiconductors have a high number of defects resulting in recombination centers for the EHPs, which in turn significantly reduce the betavoltaic current and lead to very low efficiency for the battery.

The best results for tritium betavoltaics have been achieved with single crystal semiconductor devices. Recent attempts have involved single crystalline semiconductor devices with a tritium source such as a tritiated polymer, aerogel or tritiated metal hydride placed in direct contact with a semiconductor junction device. Single crystalline semiconductors have longer carrier lifetimes and fewer defects resulting in much lower dark currents. Though successful use of single-crystal betavoltaics has improved the power yielded from a single betavoltaic cell, reductions in cost and the volume utilized for a single cell needs to decrease to allow betavoltaics to compete in the market place.

In addition to the above listed obstacles, the texturing of a direct conversion semiconductor device for the purpose of increasing the surface area exposed to beta radiation emission has been proposed several times in the past. For example, on page 282 of the book entitled "Polymers, Phosphors and Voltaics for Radioisotope Microbatteries" edited by K. Bower et al., the use of porous silicon and tritium inserted into porous silicon holes was proposed as a means of increasing the surface area of the semiconductor device by 20 to 50 times, in contrast to the original planar semiconductor surface area.

Each of the following published patent applications and patents propose a method for increasing the surface area of the semiconductor by textured growth of the semiconductor or a post-growth texturing method:

US Patent Application Publication 2004/0154656
US Patent Application Publication 2007/0080605
U.S. Pat. No. 7,250,323
U.S. Pat. No. 6,949,865
U.S. Pat. No. 7,939,986
U.S. Pat. No. 7,663,288
US Patent Application Publication 2011/0079791
US Patent Application Publication 2007/0080605

Central to the approaches of the above-listed patents and published patent applications is a belief that an increase in surface area exposed to radioisotope emissions will increase the power per unit volume of the direct conversion semiconductor device. The overall goal of this approach is to not only reduce the size of the direct conversion device but also to potentially reduce the cost associated with producing the equivalent surface area in a planar semiconductor device.

The problem with such an approach arises from several competing factors. The incident power from candidate radioisotopes for betavoltaics (e.g. tritium, promethium-147, nickel-63) is quite small per unit area exposed, the dark current of the semiconductor device is a very significant factor in the overall efficiency of the device; this is especially problematic when tritium is utilized. If the dark current of a device is high, due to recombination or trapping defects in the semiconductor, then the efficiency will be especially low. For this reason, it is preferable to use single crystal semiconductors that maintain a seed or preferred orientation where device defects are minimized and the dark current is sufficiently low so that power can be produced efficiently.

Unfortunately, alterations to the semiconductor junction's crystal structure, as proposed in the above-listed patents and published patent applications, risk increasing lattice defects, resulting in a high number of recombination centers for EHPs. Using the conventional processes (e.g. surface modification of single crystal betavoltaic junctions via etching/micromachining techniques in the above patents and published patent applications) typically results in creation of a direct conversion semiconductor device with a low open circuit voltage and reduced short circuit current resulting in a low overall efficiency. In addition, edge-effects associated with highly articulated surfaces contribute to generation of trapping and recombination centers leading to overall low efficiency.

BRIEF DESCRIPTION OF THE FIGURES

The foregoing and other features of this invention will be apparent from the following more particular description of the invention, as illustrated in the accompanying drawings in which like reference characters refer to the same parts throughout the different figures.

DETAILED DESCRIPTION OF THE INVENTION

The present invention relates to a tritium direct conversion semiconductor device comprised of a III-V semiconductor single crystal grown by, in one embodiment, a molecular beam epitaxy (MBE) process or, in another embodiment, by a metal organic chemical vapor deposition (MOCVD) process. The invention comprises a device structure with both a low dark current and high efficiency for conversion of tritium's beta emissions into electrical power.

It should be understood that the high efficiency and longevity (e.g. over 10 years) of the various device structure embodiments are suitable for use with other candidate radioisotopes for betavoltaic operations (e.g., promethium-147 and nickel-63).

Figure 1:
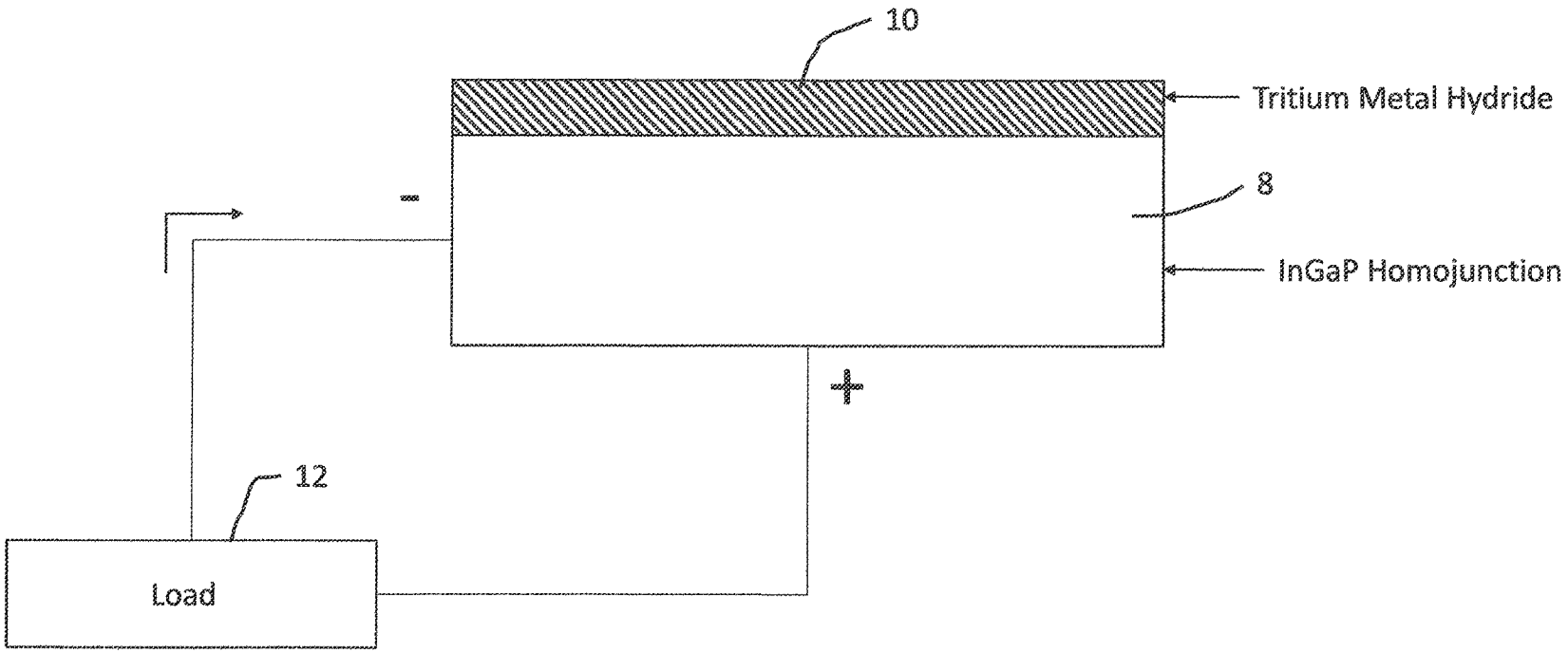
FIG. 1 illustrates an exemplary InGaP homojunction in contact with a tritium metal hydride (e.g. titanium tritide, scandium tritide, magnesium tritide, lithium tritide, palladium tritide or a combination thereof) source connected to a load.
Figure 2:
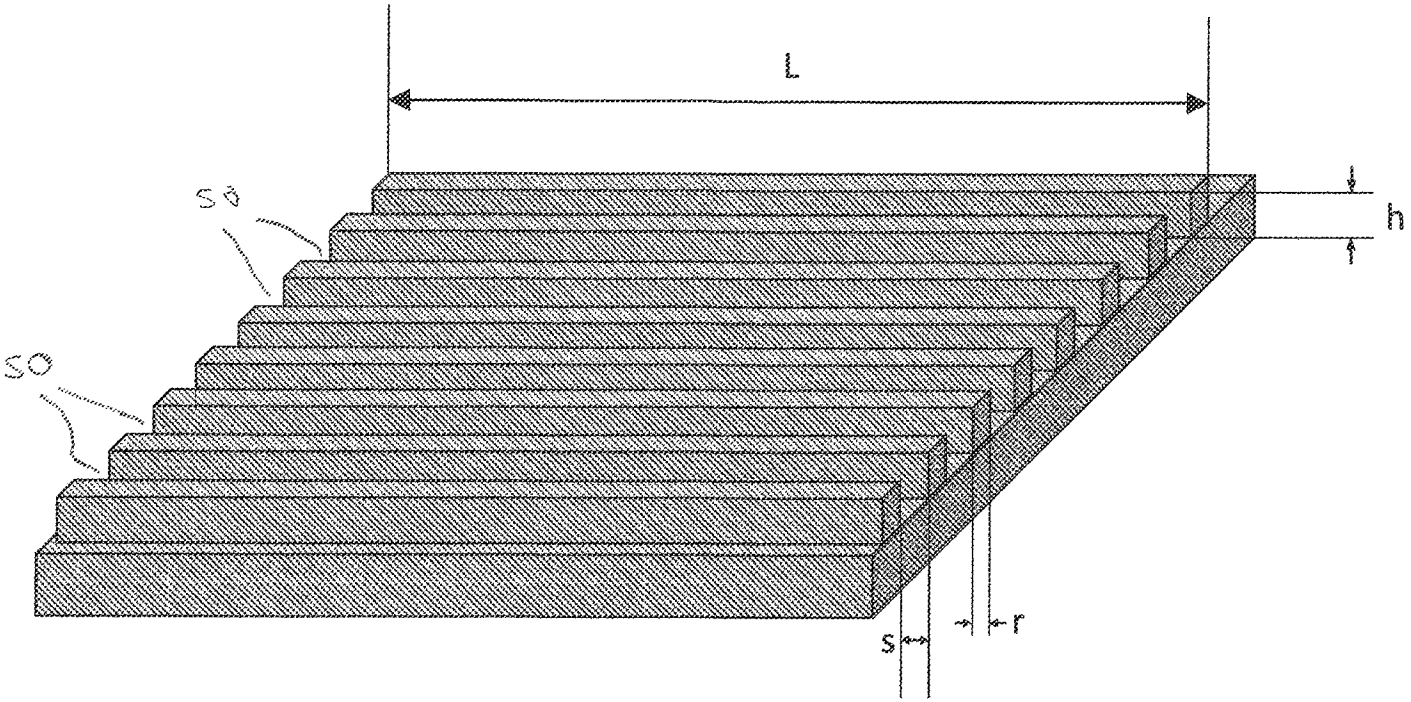
FIG. 2 illustrates a patterned semiconductor surface (e.g., having shaped features) consisting of trenches of width r and depth h having spaces between successive features of s.
Figure 3:
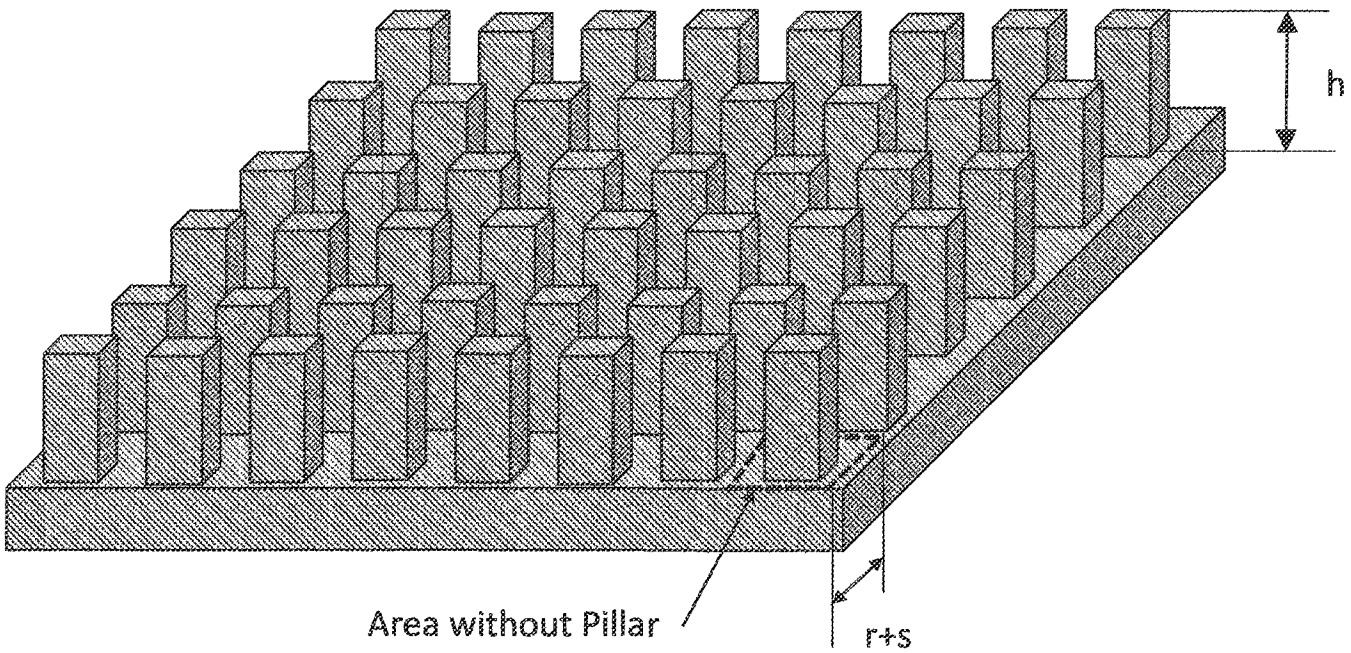
FIG. 3 illustrates a patterned semiconductor surface (e.g., having shaped surfaces) consisting of pillars of height h such that the pillars of r by r occupy an area s+r.
Figure 6:
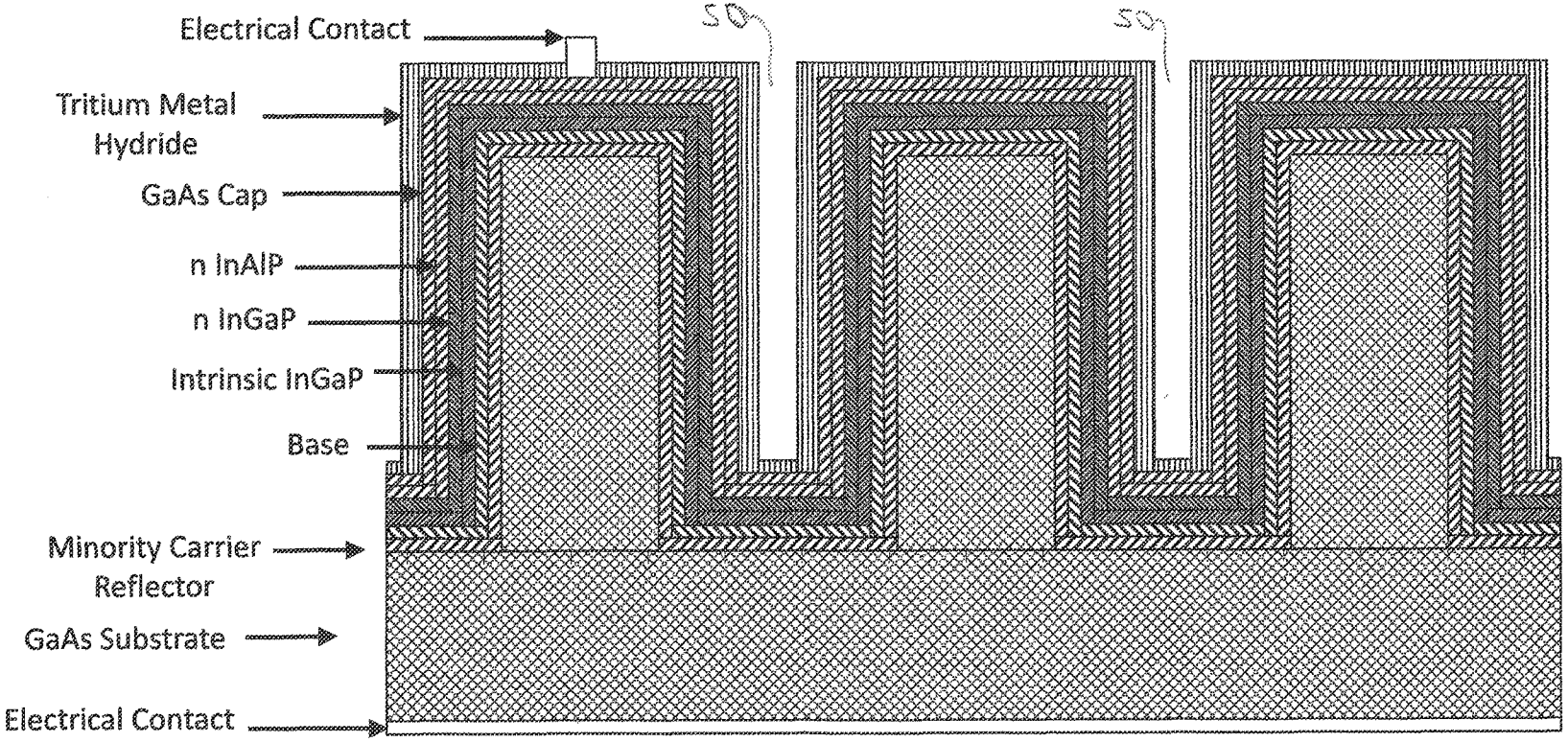
FIG. 6 illustrates the various layers of FIG. 4 from a perspective where the shaped features can be clearly seen.

One embodiment of the present invention proposes the inclusion of novel structural features within an Indium Gallium Phosphide homojunction semiconductor or betavoltaic junction 8 (comprising individual stacked layers not illustrated) in conjunction with a tritiated metal hydride source 10, as illustrated in FIG. 1, for supplying power to a load 12. A substrate is not illustrated in FIG. 1, although those skilled in the art recognize that a substrate is typically present. Those novel structural features are shown in FIGS. 2, 3 and 6.

The tritiated metal hydride source (e.g., scandium tritide, titanium tritide, palladium tritide, magnesium tritide, lithium tritide, or any combination thereof, etc.) is directly in contact with the homojunction semiconductor to generate electrical power at an efficiency of about 7.5% or higher with respect to the beta electrons impinging on the Indium Gallium Phosphide (InGaP) homojunction 8. InGaP is one of the larger band gap materials and has only recently been used in a tritium-based direct conversion battery.

One embodiment uses a composition of the Indium Gallium Phosphide homojunction comprising $In_{0.49}$ $Ga_{0.51}$ P (referred to herein as InGaP). The band gap of this semiconductor is 1.9 eV and the materials production technology has been well developed by the solar cell industry. The technology also lends itself to high quality growth with a low density of lattice defects and low dark current characteristics. In addition, InGaP may be mass produced with a high yield due to its manufacturing process maturity, thus lowering the cost of tritium betavoltaic batteries based on InGaP. InGaP device structures can be grown by metal-organic-vapor-deposition (MOCVD) as is known by those skilled in the art.

Other embodiments and physical layer structures are described and claimed in other patents and various other co-pending applications of the current assignee, e.g., U.S. Pat. Nos. 8,634,201 and 8,487,507, and co-pending patent application Ser. No. 13/925,736 (filed 24 Jun. 2013), Ser. No. 61/940,571 (filed 16 Feb. 2014) and Ser. No. 14/304,687 (filed Jun. 13, 2014).

The description of embodiments related to a direct conversion semiconductor having an increased active (surface) area and the novel, the non-obvious features thereof and a method for fabricating same are illustrated in various figures of the present application. These features and structures allow more efficient conversion of tritium beta flux to electrical power than known in the prior art and can be applied to other embodiments and physical layer structures, such as those represented by the patents and applications referred to in the immediately-preceding paragraph.

Unique to one embodiment of the present invention, enhanced surface area is achieved prior to deposition of semiconductor junction material. A betavoltaic junction or homojunction, such as an InGaP homojunction, is summarily grown conformally atop the patterned features that have been created in an underlying layer (a substrate for example) via methods known in the art (i.e. etching, deep reactive ion etching, nano-/micro-machining etc.) with attention to maintenance of crystal plane preferred orientation.

This significant difference in design and processing from the prior art reduces potential contributions to dark current by decreasing defect structure population. Some very minor contributions to defect structures in the form of discrete departures from the optimal preferred orientations can occur; these departures can be caused by inaccuracies in the manufacturing techniques, and in some cases, caused by changes in radii at geometric edges for any chosen shapes. However, despite the occurrence of such non-optimal orientations, the overall performance of the semiconductor device reflects the fact that the majority of surfaces do exist with the optimal preferred orientation.

Additionally, any resultant defect structures that occur can be mitigated or healed through annealing, etching, and other techniques known in the art, prior to growth of the III-V material, allowing for a higher quality betavoltaic junction as compared to prior art inventions. These techniques and features stand in stark contrast to the prior art where the betavoltaic junction's lattice is modified either during or after its formation to increase the device's surface area. Such modifications as described in the prior art also increase the junction's defect population and reduce overall efficiency.

In the present invention the amount of active area of a semiconductor device is increased without a concomitant (or with only an insignificant increase) in the volume or dark current per unit area of that semiconductor, leading to an increased energy density. To that end there are several topographical structures and techniques discussed herein to increase the active area, decrease the semiconductor volume, or in general, increase the ratio of betavoltaic active area to betavoltaic volume.

Central to this invention is the growth of III-V thin-film epitaxial layers conformally on top of a patterned or textured semiconductor substrate surface with articulated features such as pillars, trenches, triangles, pyramids, mounds, squares with rounded corners or other geometric shapes or features (e.g., shaped features) as shown in FIGS. 2, 3 and 6.

The formation of these topographical 3D structures on the semiconductor substrate surface may be created with techniques such as, reactive ion etching, wet chemical etching, micro or nano machining, deep reactive ion etching, or utilizing other techniques known in the art that will create a smooth seed layer along the semiconductor substrate's crystal planes suitable for MBE or MOCVD growth of a overlying III-V betavoltaic structure, e.g. a p/n junction or an n/p junction depending on the doping of the substrate. These techniques, when combined with proper device design, create additional surface area while minimizing defects harmful to betavoltaic efficiency.

The techniques and structures utilized keep the semiconductor volume relatively constant while increasing the surface area ratio of junction area formed on the patterned surface relative to that for a flat surface (e.g. up to 10 times the planar surface area or greater), and, by extension, also increasing the power and energy density of the betavoltaic device. MBE and MOCVD growth of III-V structures are mature processes that can create junctions with minimal defects allowing for high efficiency betavoltaic devices (See for example, *Phys. Today* issue of December 2012).

FIGS. 2 and 3 illustrate two of the many possible approaches for achieving increased surface area, namely, pillars and trenches. Generally, any non-planar shape will increase the surface area. For both approaches, processing begins by utilizing deep reactive ion etching (DRIE) or other techniques known in the art to form geometric patterns (as depicted by FIGS. 2 and 3) on the bare semiconductor substrate (e.g. GaAs, Ge, GaP and Silicon, etc). The substrates may be N-doped or P-doped.

In another embodiment it may be desired to grow an MBE/MOCVD foundational layer on the substrate. In one embodiment a thickness of the foundational layer is equivalent to the greatest depth to which a geometric feature will be etched. The foundational layer may be useful in instances where a derived benefit may be experienced by the semiconductor junction (e.g. high crystal quality for seed layer MOCVD growth). The derived benefit referred to here is the high quality crystal for the seed layer. Thus the lower defect population on the faces of the exemplary trenches or pillars of FIGS. 2 and 3 are important for achieving a high quality growth of the MBE/MOCVD growth (i.e., the betavoltaic junction). The array of geometric patterned shapes greatly increases the possible surface area that can subsequently receive deposition of semiconductor junction material via MBE/MOCVD processes, for example.

After the DRIE process or another process for forming the patterns, the sample may be annealed and/or exposed to wet/dry etch to remove damage and/or contaminants and/or detritus left behind by the DRIE process, leaving a high quality surface for junction formation. As the layers of the junction are formed, their shape conforms to the shape of the underlying layer.

In one embodiment, a preferred crystallographic planar orientation is maintained on all orthogonal surfaces of the topographically modified (i.e., shaped features formed therein) III-V semiconductor substrate. It should be noted in one embodiment that the parent substrates are initially procured with a (100) preferred orientation in plan; this (100) preferred orientation is known to the inventors to produce a seeding pattern for subsequent p/n junction growth that produces an optimal betavoltaic performance in the III-V semiconductor.

Given a planar substrate surface as a starting point that possesses the (100) preferred orientation, subsequent semiconductor nucleation and growth on that surface produces p/n junctions that preserve the (100) seed orientation, as growth occurs along the [100] direction (orthogonal to the (100) plane). Given the symmetry of some cubic (zinc-blende) structures (e.g., GaAs), other diamond cubic structures (e.g. Ge, Si), and other similar materials, planes orthogonal to the (100) plane, namely (010) and (001) planes, are crystallographically identical to the (100) plane. Therefore, orthogonal surface modifications of the raw substrate that seek to produce the articulated 3-D structures (pillars, trenches) simply expose these other orthogonal (but crystallographically identical) planes.

As illustrated in FIGS. 2 and 3, substrates are modified to produce extended orthogonal surface areas such that the (100) preferred seed orientation is still preserved throughout the articulated 3-D modified surface. The combination of the substrate's unique cubic symmetry in concert with the initial (100) seed layer orientation, therefore, allows for subsequent deposition (via nucleation and growth) of p/n junction materials that maintain the optimal (100) preferred orientation on all of the planar (orthogonal) surfaces produced by the exposed geometric faces in the articulated 3-D substrate.

After formation of the shaped features the fabrication process continues with growing an n/p or p/n betavoltaic junction on the faces of the textured semiconductor substrate via MBE or MOCVD. Some betavoltaic junctions that may be grown are described in one or more of the commonly owned patents and patent applications identified above. The novel construction of these 3D topographical structures with each side having an identical orientation (e.g. (100) orientation) allows for uniform growth of the n/p or p/n junction on each face of the articulated surface.

One embodiment uses a composition of the Indium Gallium Phosphide homojunction comprising $In_{0.49}$ $Ga_{0.51}$ P (subsequently referred to as InGaP) grown via MBE or MOCVD. The InGaP structure is grown conformally on faces of the textured surface of the underlying substrate.

The band gap of this semiconductor junction is 1.9 eV and the materials production technology is well developed by the solar cell industry. The technology also lends itself to high quality growth with a low density of lattice defects and low dark current characteristics. In addition, InGaP may be mass produced with a high yield due to its manufacturing process maturity, thus lowering the cost of tritium betavoltaic batteries based on InGaP.

InGaP device structures are normally grown by metal-organic-vapor-deposition (MOCVD) as is known by those skilled in the art. Additionally, the growth of InGaP on these articulated faces or shaped features can yield conformal betavoltaic structures with aspect ratios of up to 10:1 or greater, yielding even lower cost betavoltaic devices with high power outputs and energy densities.

Figure 4:
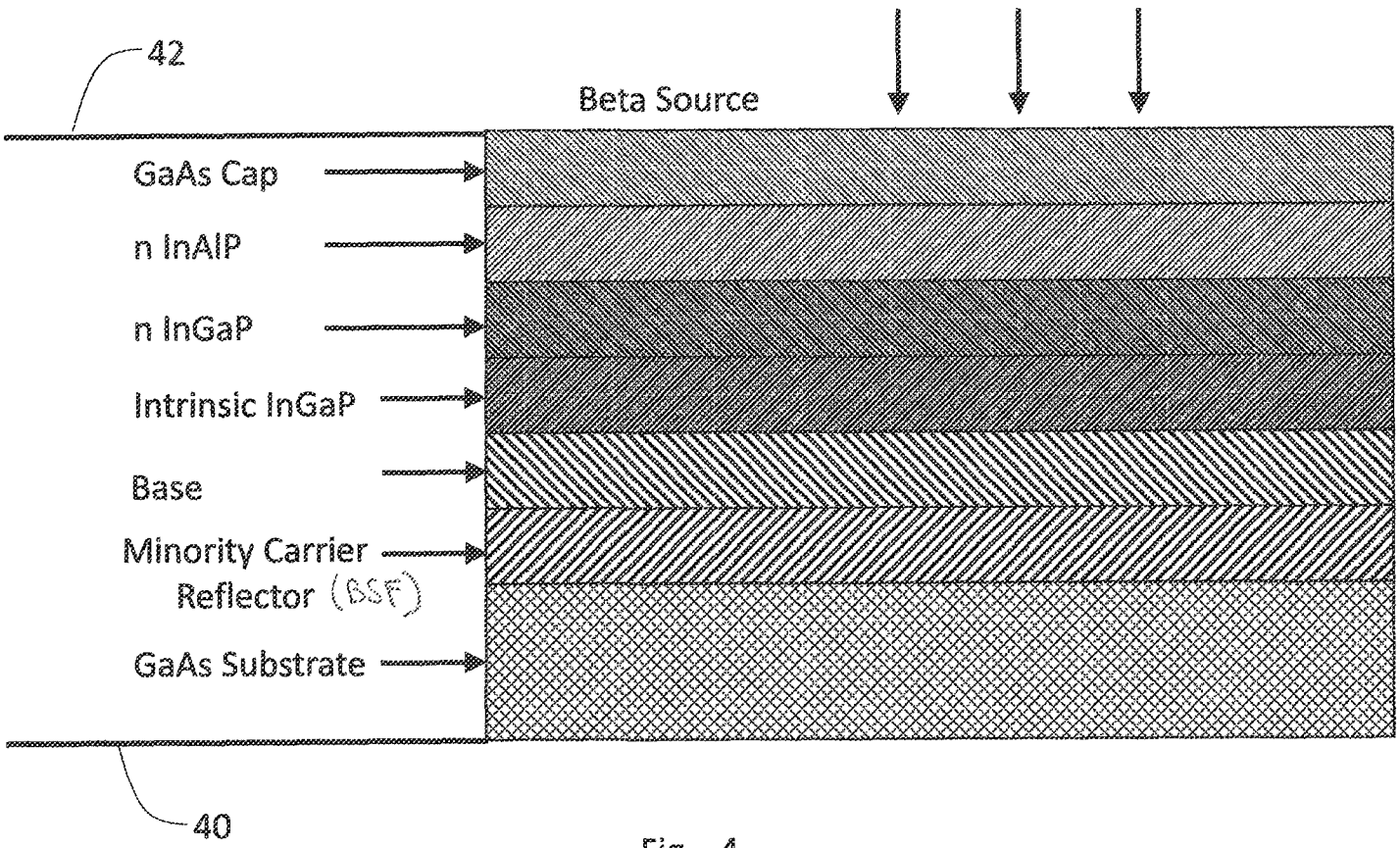
FIG. 4 illustrates an exemplary layered structure typical of an InGaP betavoltaic cell.

FIG. 4 illustrates exemplary individual layers of the n/p homojunction semiconductor 8, (note that if the substrate is doped p type then it is referred to as an n/p (n on p) homojunction and if the substrate is doped n type then it is referred to as a p/n homojunction (p on n)) comprising, from the bottom:

- a pGaAs substrate
- a p+InGaP layer (a back surface field (BSF) or minority carrier reflector)
- a pInGaP base layer
- an intrinsic InGaP layer (for preventing diffusion of dopants between the p-doped and n-doped layers)
- an nInGaP emitter layer
- an nInAlP layer (window layer closely lattice matched to the nInGaP emitter layer and the nGaAs cap layer that allows electrons to pass to the nGaAs cap layer and reflects holes back to the emitter)
- an nGaAs cap layer (may be highly doped in one embodiment)

It should be noted that in other embodiments the dopant types may be reversed from those set forth above, additional layers may be added, and certain layers deleted from the layers presented in FIG. 4. If the dopant types are reversed from those set forth above, the structure may be referred to as a p/n homojunction semiconductor. Additionally, any of the substrates and/or structures described in commonly-owned patents and patent applications, including those listed herein, may be grown on the 3D high aspect ratio or high surface area modified (i.e., including shaped features formed therein) substrates as described herein.

There are several features of this n/p structure that allow efficient betavoltaic energy conversion:

(a) High quality, large band gap semiconductor junction resulting in a highly efficient device;

(b) Back-surface field (BSF) reflective layer comprising a highly doped p+InGaP layer (can also be created by p-type InAlP, InAlGaP or ZnSe);

(c) A lattice-matched n-type InAlP window layer to reflect holes back to the emitter leading to a low dark current (can also be created with a highly doped n+pseudomorphic material, InAlGaP, ZnSe, AlAs or AlAsP);

(d) A GaAs cap layer of about a few hundred angstroms or less covering the top surface; and (e) a 1000 to 3000 Å layer of intrinsic InGaP to act as a buffer to diffusion of the p type dopant (usually Zn) into the n-type emitter region. The intrinsic layer may also be less than 100 Å.

Each of these features contributes to the achievement of the low dark currents required for efficient betavoltaic energy conversion.

The novel lattice-matched InAlP window layer prevents the formation of dislocations at the InAlP-InGaP interface, which would increase the dark current.

The GaAs cap layer keeps the InAlP layer from oxidizing, the absence of which could introduce defects for EHP recombination at the InAlP-InGaP region. This cap layer, therefore augments hole reflection at that interface. The GaAs cap layer does not absorb a significant percentage of the beta flux, and therefore the small absorption can be tolerated. It should be noted that the cap layer can be made out of other III-V materials or combinations of III-V materials that can function in a similar capacity. The GaAs Cap layer acts as a current collector for the betavoltaic junction serving yet another purpose.

Tritium beta particle penetration in semiconductors is less than about one micron. Thus, it is clear that the emitter, window and GaAs cap layers need to be very thin so that most of the beta particle absorption occurs in the high field region in the depletion layer (with respect to FIG. 4, the intrinsic InGaP layer or in another embodiment a material region between a p-doped and an n-doped region).

As shown in FIG. 4, ohmic contacts 40 and 42 for both polarities can be made to the GaAs substrate and the GaAs cap layer.

The betavoltaic device with shaped features is completed by conformally coating a hydride-capable metal (e.g titanium, magnesium, scandium, lithium, palladium etc.) via methods known in the art (e.g. evaporation, sputtering, electro-deposition, atomic layer deposition, chemical vapor deposition etc.). This conformal coating is directly deposited onto the faces of the 3D modified surfaces that now comprise the betavoltaic structure.

Tritium may also be stored as part of a polymer or aerogel that is then conformally coated or deposited onto the faces of the 3D betavoltaic structure. Other radioisotopes may also be deposited onto the 3D betavoltaic structures (e.g. nickel-63, promethium-147, phosphorus-33).

In the case of hydride-capable metals conformally coated onto the betavoltaic structure, the metal tritide is formed by exposure to tritium gas at pressures approximately ranging from less than 0.01 to greater than 20 Bar and temperatures ranging from approximately room temperature to 600° C. for durations ranging minutes to days. Thicknesses of the metal tritide layer are typically on the order of microns and can be as thin as 50-100 nanometers.

A cap layer of palladium ranging from approximately 1.0 nanometer to 500.0 nanometers may be deposited over a scandium, titanium, magnesium, lithium, or other suitable metal in order to reduce the tritium loading temperature and stabilize the tritium within the metal matrix after the tritide has been formed. The palladium cap layer functions primarily as a catalyst and serves to provide for an expedited rate of reaction for inducing the process of tritiation; palladium has an additional benefit for the tritiation process in that it can facilitate tritium loading of a metal tritide at significantly lower temperatures and pressures compared to processing efforts conducted in the absence of palladium. This subsequent increase in the kinetics of the tritiation process induced by the palladium cap layer does not alter the ultimate functionality of the betavoltaic cell, and it is usually deposited directly upon un-passivated surfaces (surfaces containing no oxide barriers to tritiation) of metal hydride storage layers (e.g. scandium, titanium, magnesium, lithium, or other suitable metal).

The palladium layer is typically laid down in a vacuum/inert gas atmosphere process, in order to eliminate oxygen contamination and is deposited via any of the metal deposition techniques described elsewhere herein. It should also be noted that the metal tritide layer may also be formed via an in-situ evaporation of the metal in the presence of gaseous tritium.

In some embodiments, the metal tritide is conductive (e.g. titanium tritide, scandium tritide) and can serve as both a beta emitting source and an ohmic contact. In cases where the tritide is an insulator, a regular metal point contact to the GaAs cap layer may be utilized as illustrated in FIG. 4.

Figure 5:
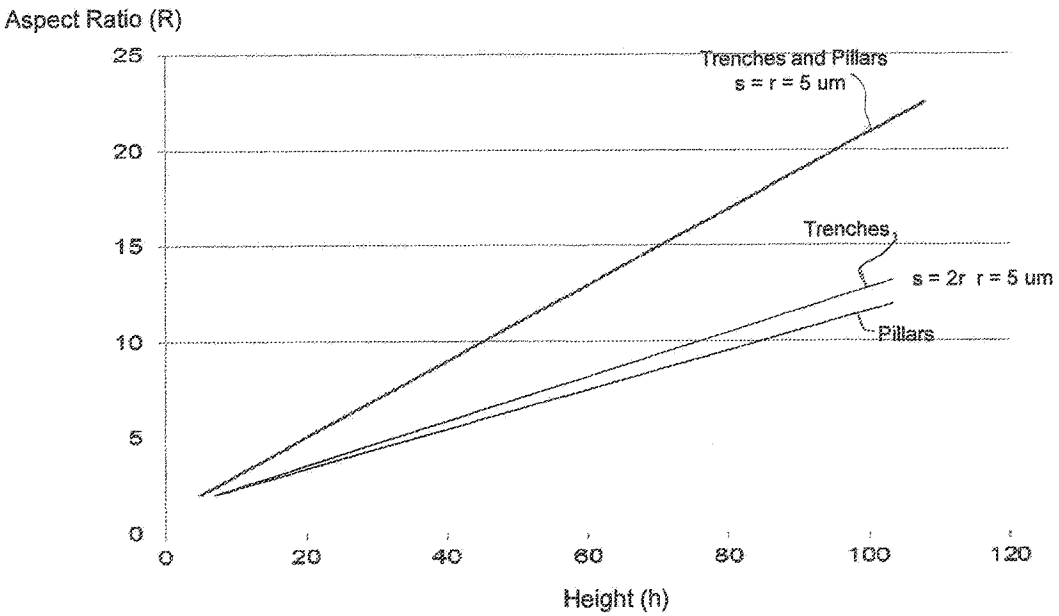
FIG. 5 illustrates calculated values of aspect ratio of surface area of surfaces modified with trenches and/or pillars relative to that for a flat surface for cases defined by s=r=5 um, and s=2r with r=5 um.

In one embodiment with pillar formations of FIG. 3, the junction area formed on the top of the pillars, the sides of the pillars and in between pillars by MOCVD can be characterized by a large aspect ratio. In particular, the junction area is increased by a factor of $\{1+[4hs/(r+s)^2]\}$ where dimensions h, s and r are defined in FIG. 3 and for cases where r=s and r=s/2. FIG. 5 shows the result of varying these values. The increased aspect ratio gives rise to increased surface area and hence an increased value of short circuit current.

For embodiments with trench formations as described by FIG. 2, the junction is formed on top of the ridges, on the sides of the ridges and in between the ridges. Similarly, one finds that if the surface is modified with trenches, the surface area can increase by a factor of $\{1+[2h/(r+s)]\}$, again where the dimensions h, s, and r are identified in FIG. 2.

As in the case of pillars, the increased aspect ratio leads to the possibility of increased values of short circuit current. This is due to the high quality of MBE or MOCVD growth of the n/p or p/n structure that can be made on the (100) orientation of all faces of the pillars or trenches.

FIG. 5 illustrates the resulting aspect ratio value as a function of h for specified values of s and r for trench and pillar features.

FIG. 6 illustrates the various layers of FIG. 4 from a perspective where the shaped features can be clearly seen. For example, looking down or along the trenches 40 of FIG. 2 one would see the layered structures with the shaped features of FIG. 6.

In all embodiments of the present invention, the voltage and current may be scaled up via stacking of the aforementioned betavoltaic cells with high aspect ratio extended surface area. Betavoltaic cell layers may be stacked vertically or arranged horizontally and configured electrically in series or parallel. Electrical connection can be established by utilizing through-vias as power lead contacts across betavoltaic cell layers, by using current-channeling interposers (e.g. flexible circuit cards) in between betavoltaic cells or groups of cells, or by other methods common in the art. It should be noted that varying stacking configurations produce varying voltage and current outputs from the betavoltaic composite device.

An additional approach to increasing the power/energy density of stacked high aspect ratio extended surface area betavoltaic cells is to thin the back surfaces of the betavoltaic semiconductor substrates by etching, polishing, grinding, epitaxial-lift-off and/or other lapidary techniques known in the art. It should be noted that typical starting points for GaAs substrate thicknesses are 625 microns, but can be thinned using the aforementioned methods. Similarly, Germanium substrates are typically 175 microns thick but may be thinned using methods known in the art.

The referenced aspect ratio of the patterned features of shaped features is defined as the ratio of the opening or cut to the depth of the opening or cut. Certain embodiments of the invention exhibit an aspect ratio of at least 2:1 to as great as 500:1. While certain embodiments of the present invention have been shown and described herein, such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A betavoltaic power source comprising a source of beta particles;

a substrate with shaped features defined therein;

a InGaP betavoltaic junction disposed between the source of beta particles and the substrate, and also having shaped features therein responsive to the shaped features in the substrate, the InGaP betavoltaic junction device for collecting the beta particles and for generating electron hole pairs responsive thereto; and wherein the substrate comprises a GaAs substrate having an orientation of (100) and surfaces of the shaped features having an orientation of (100), (010), or (001).

2. The power source of claim 1 wherein the shaped features comprise an array of one or more of trenches and pillars.

3. The power source of claim 1 wherein the substrate comprises a gallium-arsenide substrate, a geranium substrate or a silicon substrate.

4. The power source of claim 1 wherein the shaped features in the substrate expose crystallographically identical planes on which the InGaP betavoltaic junction is formed.

5. The power source of claim 1 wherein the InGaP betavoltaic junction comprises a GaAs cap layer, a InAlP window layer, an InGaP emitter layer, an intrinsic layer, a base layer, and a minority carrier reflector layer.

6. The power source of claim 5 wherein trenches are formed in the GaAs cap layer, the InAlP window layer, the InGaP emitter layer, the intrinsic layer, the base layer, and the minority carrier reflector layer.

7. The power source of claim 1 wherein the substrate is doped n-type or p-type.

8. A method for forming a betavoltaic power source using beta particles emitted from a source, the method comprising:

forming a substrate;

forming shaped features within the substrate;

forming a InGaP betavoltaic junction disposed between the source of beta particles and the substrate, the InGaP defining shaped features therein responsive to the shaped features in the substrate, the InGaP betavoltaic junction device for collecting the beta particles and for generating electron hole pairs responsive thereto; and wherein the substrate comprises a GaAs substrate having an orientation of (100) and surfaces of the shaped features having an orientation of (100), (010), or (001).

* * * * *